United States Patent [19]

Kondo et al.

[11] Patent Number: 4,540,910

[45] Date of Patent: Sep. 10, 1985

[54] SPARK PLUG FOR INTERNAL-COMBUSTION ENGINE

[75] Inventors: Ryoji Kondo, Okazaki; Kozo Takamura, Nagoya; Kanji Higuchi, Hekinan, all of Japan

[73] Assignee: Nippondenso Co., Ltd., Kariya, Japan

[21] Appl. No.: 552,964

[22] Filed: Nov. 17, 1983

[30] Foreign Application Priority Data

Nov. 22, 1982 [JP] Japan ..... 57-204920
Mar. 16, 1983 [JP] Japan ..... 58-45236

[51] Int. Cl.[3] ..... H01T 13/20

[52] U.S. Cl. ..... 313/11.5; 313/141; 313/142

[58] Field of Search ..... 313/141, 142, 11.5

[56] References Cited

U.S. PATENT DOCUMENTS

| | | | |
|---|---|---|---|
| 2,470,033 | 5/1949 | Hensel | 313/142 |
| 3,146,370 | 8/1964 | Duyne et al. | 313/118 |
| 3,407,326 | 10/1968 | Romine | 313/141 |
| 3,868,530 | 2/1975 | Eaton et al. | 313/141 |
| 4,122,366 | 10/1978 | Stutterheim et al. | 313/141 |
| 4,488,081 | 12/1984 | Kondo et al. | 313/141 |

FOREIGN PATENT DOCUMENTS 2256823 7/1975 Fed. Rep. of Germany .

*Primary Examiner*—Palmer Demeo
*Attorney, Agent, or Firm*—Cushman, Darby & Cushman

[57] ABSTRACT

A spark plug for internal-combustion engines has a spark discharge gap defined between at least two electrodes opposing to each other, and a platinum-containing wear-resistant discharging layer provided on one of the electrodes. The spark plug has a thermal stress relieving layer disposed between the discharging layer and the base metal constituting the one eletrode. The thermal stress relieving layer is made of a platinum base alloy containing nickel, which constitutes the base metal. The discharging layer may be made of a material consisting essentially of 70 to 90 wt % platinum and 30 to 10 wt % iridium. The thermal stress relieving layer may be made of a material consisting essentially of 5 to 95 wt % platinum and 95 to 5 wt % nickel. Another platinum-containing wear-resistant layer may be provided on the other electrode, the wear-resistant layer being made of a material consisting essentially of 5 to 60 wt % nickel and 95 to 40 wt % platinum.

8 Claims, 13 Drawing Figures

SPARK PLUG FOR INTERNAL-COMBUSTION ENGINE

BACKGROUND OF THE INVENTION

The present invention relates to a spark plug suitable for use in internal-combustion engines for automobiles and the like.

Hitherto, there is known a spark plug of this type, as shown in the specification of West Germany Pat. No. 2,256,823, which is improved to be longer in life by joining a heat-resistant and wear-resistant discharging layer made of platinum or the like to the spark discharge end of the central electrode by means of the resistance welding method thereby to minimize the wear of the spark discharge end of the central electrode.

In the conventional spark plug, however, the discharging layer often falls off disadvantageously.

As the result of the examination of the frequent falling off of the discharging layer, the inventor has found that the joint between the discharging layer and the central electrode has been cracked and oxidized, and that the discharging layer has fallen off at the position of this cracked and oxidized portion.

This phenomenon is considered to be largely owing to the thermal stress caused by the difference in linear expansion coefficient between platinum constituting the discharging layer and nickel which is the base metal constituting the central electrode.

More specifically, in the conventional spark plug, it is intended to greatly improve the wear resistance of the electrode by employing the platinum discharging layer as the discharge surface of the central electrode and/or the ground electrode. The discharging layer is, however, constituted by a single chip made of an alloy of platinum and iridium, or an alloy of platinum and tungsten, or an alloy obtained by adding a small amount of nickel to platinum and iridium. The linear expansion coefficient of the alloy is about $8\text{–}9\times10^{-6}/°C.$; hence, there is a linear expansion coefficient difference of about $5\times10^{-6}/°C.$ between the discharging layer and the central electrode (and/or the ground electrode). However, the spark plug is used under various operating conditions, high loads and low loads, i.e., the spark plug is alternately and repeatedly subjected to high temperatures and low temperatures. Owing to this alternate repetition of high and low temperatures and the linear expansion coefficient difference, the joint between the discharging layer and the central electrode (and/or the ground electrode) is repeatedly subjected to the thermal stress to generally cause transverse crackings (a) as shown in FIG. 3-A and oxidized portions (b) on the weld surface as shown in FIG. 3-B, resulting in the falling off of the discharging layer 7 unfavorably. It is to be noted that although a platinum chip 9 on the ground electrode 8 is transversely cracked and oxidized, since the ground electrode 8 becomes higher in temperature than the central electrode 6, the platinum chip 9 falls off owing to the wear of this electrode itself. For coping with this situation, hitherto, various methods have been devised. However, none of the methods are effective for engines in which temperature becomes extraordinarily high and for electrode constructions in which the plug electrode becomes high in temperature, e.g., the electrode construction shown in FIG. 4 (in which the central and ground electrodes are projected about 3 to 7 mm more than those of the conventional plug).

SUMMARY OF THE INVENTION

Accordingly, it is a primary object of the invention to provide a spark plug improved to be excellent in both heat resistance and wear resistance thereby to overcome the above-mentioned problems encountered by the conventional spark plug.

To this end, according to the invention, there is provided a spark plug having a spark discharge gap defined between at least two electrodes opposing to each other, and a platinum-containing wear-resistant discharging layer provided on at least one of the electrodes, characterized in that a thermal stress relieving layer is interposed between the discharging layer and the base metal constituting the one electrode, the thermal stress relieving layer being made of a platinum base alloy containing nickel as a main component of the base metal.

The above and other objects, features and advantages of the invention will be apparent from the following detailed description taken in connection with the accompanying drawings.

BRIEF DESCRIPTION OF THE DRAWINGS

FIG. 10-B is a graph showing the relationship between the rate occurring of the longitudinal cracks (b) and the Ir content of the discharging layer.

DESCRIPTION OF THE PREFERRED EMBODIMENTS

Figure 1:
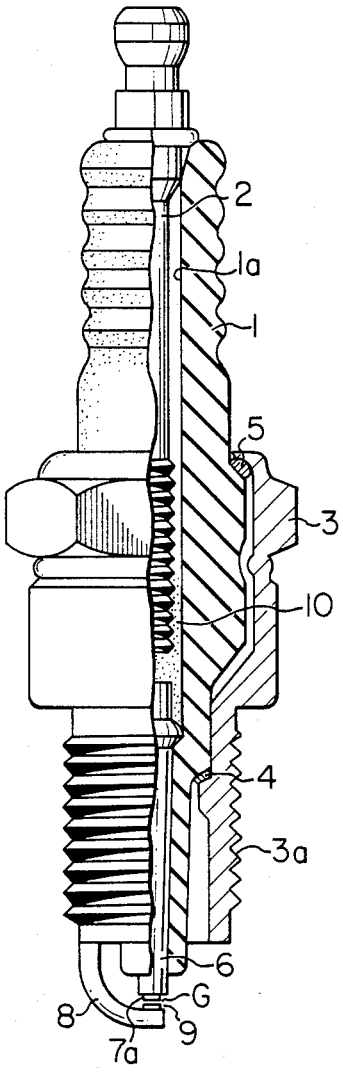
FIG. 1 is a partly-sectioned front elevational view of an embodiment of the spark plug in accordance with the invention.
Figure 2:
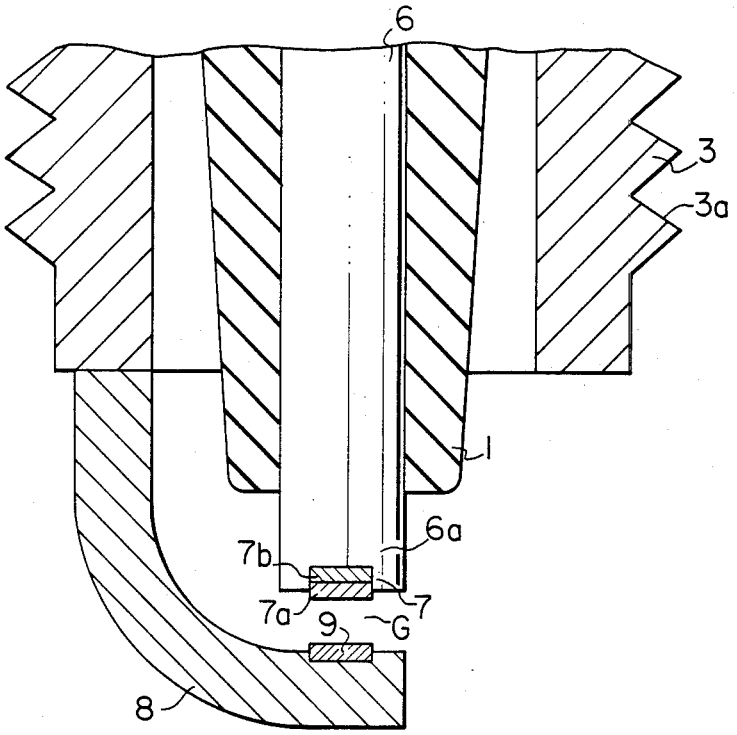
FIG. 2 is an enlarged sectional view of an essential part of the spark plug shown in FIG. 1.
Figure 3A:
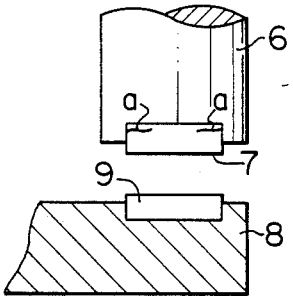
FIGS. 3-A and 3-B are partially sectional views of an seential part of a conventional spark plug, for showing crackings and oxidized portions caused in the spark plug, respectively.
Figure 3B:
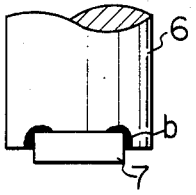
Figure 4:
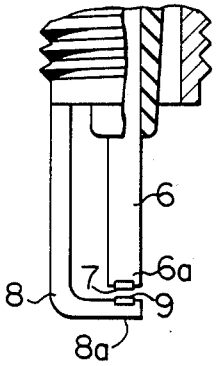
FIG. 4 is a partly-sectioned front elevational view of an essential part of the spark plug in accordance with the invention.

The invention will be described hereinunder in detail through an embodiment. In FIGS. 1 and 2, an insulator 1 made of alumina porcelain has an axial bore 1*a* provided in its center. A center shaft 2 made of a carbon steel is received through the upper part of the axial bore 1*a* in the insulator 1. A cylinderical housing 3 is constituted by an ordinary carbon steel and has the insulator 1 fixed therein through a ring-shaped hermetic packing 4 and a caulking ring 5. It is to be noted that the housing 3 is provided with a threaded portion 3*a* for fixing the same to the cylinder block of an internal-combustion engine. A central electrode 6 is constituted by a nickel-chromium (Ni-Cr) alloy or Inconel 600 (trade mark) as the base metal. A double platinum layer 7 which is an essential part of the invention is joined to the end of the central electrode 6 by means of the resistance welding method. The resistance welding for this joining was carried out by employing a generally used welding machine and welding conditions: a welding pressure of 15 to 35 kgF; an energizing time of 1 to 20 seconds; and an energizing current of 600 to 900 A. The double platinum layer 7 is constituted by a discharging layer 7*a* and a thermal stress relieving layer 7*b*. The discharging layer 7*a* is made of an platinum base alloy, e.g., an alloy consisting essentially of 70 to 90 wt % platinum (Pt) and 30 to 10 wt % iridium (Ir). The thermal stress relieving layer 7*b* is made of an alloy of platinum and a base metal, e.g., an alloy consisting essentially of 20 to 95 wt % Pt and 80 to 5 wt % nickel. A ground electrode 8 is made of a heat-resistant and wear-resistant metal which is constituted by a base metal similar to that constituting the central electrode 6. A platinum chip layer 9 is joined to the ground electrode 8 by means of the resistance welding method. The platinum chip layer 9 is made of a Pt base alloy similar to that for the discharging layer 7*a*. An electrically-conductive glass seal layer 10 filled in the axial bore 1*a* in the insulator 1 is constituted by such a mixture of copper powder and a low-melting glass as shown in U.S. Pat. No. 2,106,578. The seal layer 10 provides an electrical connection between the intermediate shaft 2 and the central electrode 6 as well as serves to fix both of them in the axial bore 1*a* in the insulator 1 so that they cannot move at all. In the drawings, a symbol G denotes a spark discharge gap. In this case, for example, the thermal stress relieving layer 7*b* having a thickness of about 0.15 mm is joined to the end of the central electrode 6 by means of the resistance welding method. Subsequently, the discharging layer 7*a* having a thickness of about 0.25 mm is joined onto the thermal stress relieving layer 7*b* by means of the resistance welding method. The welding conditions are the same as the above. The diameter of each of the layers 7*a*, 7*b* is about 0.9 mm.

It is to be noted that the double layer 7 may be manufactured by such a way that the laminate of the material for the discharging layer 7*a* and that for the thermal stress relieving layer 7*b* is rolled and heat-treated and is then blanked by means of a press machine.

The spark plug in accordance with the invention has no substantial defect portions, such as the above-mentioned crackings and oxidized portions, which are not practically allowable, even when the electrode temperature rises. For preventing the occurrence of such defect portions, it is necessary to reduce thermal stress. In order to reduce the thermal stress, the discharging layer 7 is constituted by two layers, i.e., the thermal stress relieving layer 7*b* made of an alloy of Pt and Ni which has a linear expansion coefficient relatively close to that of the Ni base alloy as the base metal 6*a*, and the discharging layer 7*a* made of a platinum base alloy. In this case, the thermal stress relieving layer 7*b* is made of an alloy consisting essentially of 95 to 5 wt % Pt and 5 to 95 wt % Ni. On the other hand, the discharging layer 7*a* is made of an alloy consisting essentially of 90 to 70 wt % Pt and 10 to 30 wt % Ir, or an alloy obtained by adding 2 to 5 wt % Ni to this alloy composition. Owing to such alloy compositions, there is provided a gradual change in linear expansion coefficient of the portion between the base metal 6*a* and the discharging layer 7*a*. More specifically, it becomes possible to reduce the thermal stress in a large degree and eliminate the occurrence of the above-mentioned transverse crackings and oxidized portions, by providing between the base metal 6*a* and the discharging layer 7*a* the thermal stress relieving layer 7*b* having a linear expansion coefficient intermediate in value between those of the base metal 6*a* and the discharging layer 7*a*.

Figure 5B:
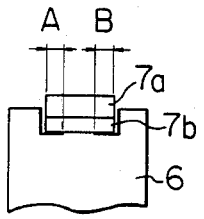
FIGS. 5-A and 5-B show the mutual relationship among the thickness (t) of a thermal stress relieving layer, the plug central electrode temperature, and the depth (A+B) of defect portions (A, B) such as transverse crackings and oxidized portions.
Figure 5A:
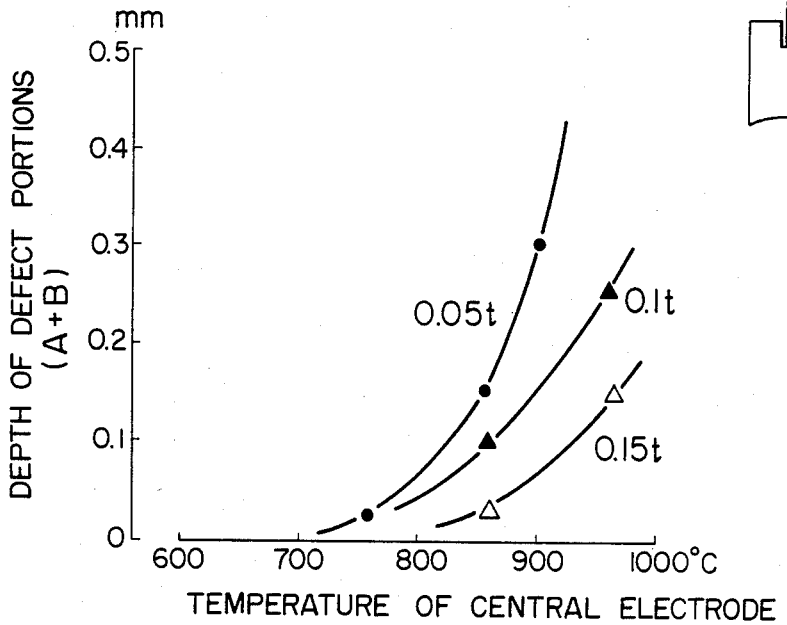

The following is the description of the action of the thermal stress relieving layer 7*b*. Since the thermal stress relieving layer 7*b* exists between the base metal 6*a* and the discharging layer 7*a*, the thermal stress relieving layer 7*b* is subjected to both thermal stresses caused owing to the differences in linear expansion coefficient between the thermal stress relieving layer 7*b* itself and both the materials (the base metal 6*a* and the discharging layer 7*a*). Therefore, the thermal stresses can be changed by properly selecting the kind of material for the thermal stress relieving layer. In addition, the distribution of the thermal stresses applied from the materials of both the base metal 6*a* and the discharging layer 7*a* can be changed by selecting the thickness (t) of the thermal stress relieving layer 7*b*. An example of this is shown in FIGS. 5-A and 5-B. The plug central electrode temperatures plotted along the abscissa in FIG. 5-A are values obtained by changing the operating conditions of the internal-combustion engine. On the other hand, the ordinate in the Figure takes values obtained by measuring the depth (A+B) of the defect portions A, B in the weld surface shown in FIG. 5-B from the side surfaces of the discharging layer 7*a* (having an alloy composition: 78 Pt - 20 Ir - 2 Ni by weight %). It is to be noted that transverse cracking and oxidation simultaneously develop in the high-temperature region, resulting in erosions as A, B in FIG. 5-B. This is defined as the defect portion depth. The material for the thermal stress relieving layer 7*b* was an alloy consisting essentially of 90 wt % Pt and 10 wt % Ni. As the thickness (t) of the thermal stress relieving layer, three levels were employed: 0.05 mm, 0.10 mm and 0.15 mm. It is to be noted that the composition of the base metal 6*a* consists essentially of 15.5 wt % Cr, 8 wt % Fe, 0.5 wt % Mn and the balance Ni, which is equivalent to that of Inconel 600 (trade mark). The evaluation was made as the result of the test carried out for 100 hours in a two-minute cycle, one minute for idling and another minute for the wide-open-throttle operation (W.O.T.), by employing a 2600 cc four-cycle water-cooled internal-combustion engine. As will be obvious from FIG. 5-A, as the plug central electrode rises in temeprature, the defect portions remarkably increase in depth. In addition, it is understood that the defect portion depth changes also according to the thickness of the thermal stress relieving layer *7b*.

Figure 6:
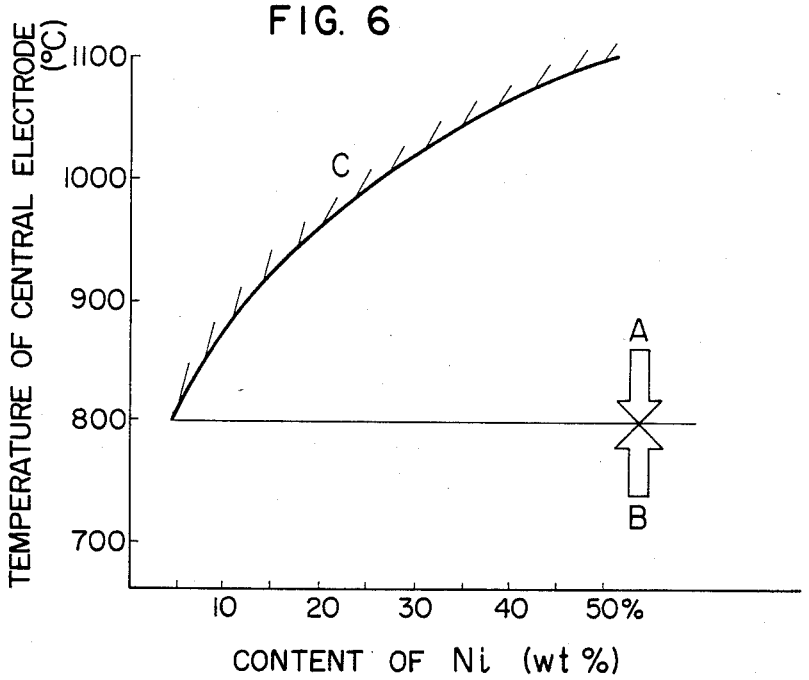
FIG. 6 is a graph showing the mutual relationship among the Ni content of the thermal stress relieving layer, the plug central electrode temperature, and the transverse cracking occuring region (C)

FIG. 6 is a graph showing the relationship among a standard plug temperature, the Ni content of the thermal stress relieving layer and the region C where transverse crackings are caused. In this case, the standard plug temperature means the temperature at the end of the central electrode of the conventional spark plug (W16EX-U, manufactured by Nippon Denso Co., Ltd.) for four-wheel cars. The standard plug temperature is a value representative of the temperature inside the combustion chamber. In addition, the values of the plug temperature in accordance with the invention indicate the plug temperatures measured in the wide-open-throttle operation during the engine test performed for 160 hours in a two-minute cycle, one minute for idling and another minute for the wide-open-throttle operation, to find the conditions where transverse cracking and oxidation occur. In FIG. 6, although the maximum temperatures of ordinary plugs are generally 800° C. (the region B), maximum temperatures of plugs of engines having extremely severe operating conditions or plugs having the central and ground electrodes projecting 3 to 7 mm more than those of ordinary plugs exceed 900° C. (the region A).

Figure 7:
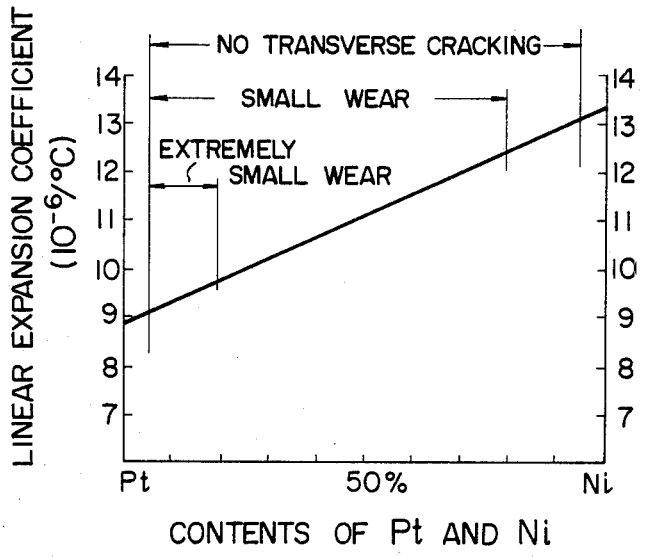
FIG. 7 is a graph showing the mutual relationship among the Ni content of the thermal stress relieving layer in FIG. 6, the linear expansion coefficient of the thermal stress relieving layer, and the occurence of transverse crackings as well as the wear of a discharging layer.

Therefore, the Ni content of the thermal stress relieving layer *7b* is preferably selected to fall between 5 wt % and 95 wt %. The Ni content will be discussed hereinunder with reference to FIG. 7. As will be obvious from FIG. 7, if the Ni content of the thermal stress relieving layer *7b* is within the above-mentioned range, there is no fear that the any transverse cracking will be caused in the thermal stress relieving layer *7b* itself. Moreover, if such a case is considered that the discharging layer *7a* has worn out and the thermal stress relieving layer *7b* is employed as the discharging part, the Ni content is preferably selected to fall between 5 wt % and 80 wt % since the wear degree increases as the thermal stress relieving layer *7b* has a larger Ni content. It is understood from the results shown in FIG. 7 that if a higher wear resistance is required, the Ni content should fall between 5 wt % and 20 wt %.

Figure 8:
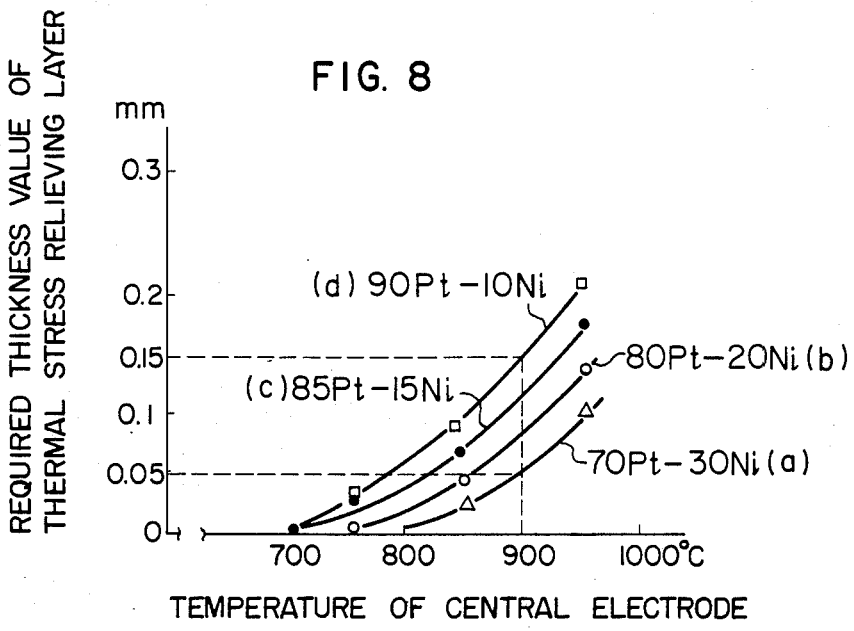
FIG. 8 is a graph showing how the relationship between the thermal stress relieving layer thickness required for the spark plug in accordance with the invention and the plug central electrode temperature, changes according to the kinds of materials constituting the thermal stress relieving layer.

FIG. 8 shows the results of the test carried out in the same manner as in the case shown in FIG. 6, in which the material for the thermal stress relieving layer *7b*, i.e., the linear expansion coefficient thereof was changed and the thickness (t) of the thermal stress relieving layer *7b* was also changed. As the materials for the thermal stress relieving layer *7b*, various alloys were employed having their respective compositions as follows: 95 Pt - 5 Ni; 85 Pt - 15 Ni; 80 Pt - 20 Ni; 75 Pt - 25 Ni; 70 Pt - 30 Ni; 65 Pt - 35 Ni; and 60 Pt - 40 Ni. It is to be noted that the numerals of the respective materials denote percentages by weight of Pt and Ni. The materials were evaluated by the engine test similar to that in the case of FIG. 6. As the result of the evaluation, the required thickness of the thermal stress relieving layer was obtained by changing the materials for the thermal stress relieving layer and the thickness thereof and obtaining points from which the defect portions remarkably develop in depth.

It is to be noted that the above-mentioned materials for the thermal stress relieving layer having such compositions 95 Pt - 5 Ni, 60 Pt - 40 Ni and 65 Pt - 35 Ni by weight % were exceedingly large in the defect portion depth and therefore were not shown in FIG. 8.

In FIG. 8, for example, in the case of the material having an alloy composition of 70 Pt - 30 Ni by weight, and when the plug central electrode temperature is 900° C., if the intersection between the material curve and the line of 900° C. is read on the ordinate, then the required thickness of the thermal stress relieving layer is found to be 0.05 mm. More specifically, in the case where the material for the thermal stress relieving layer has an alloy composition consisting essentially of 70 wt % Pt and 30 wt % Ni, under the conditions where the plug central electrode temperature is 900° C., the thermal stress relieving layer is required to have a thickness of at least 0.05 mm. A thickness less than 0.05 mm causes the defect portions to greatly increase in depth. It is to be noted that the maximum temperature of the central electrode of the plug within the ordinary practical region in internal-combustion engines is about 900° C.; hence, there is no practical problem if no defect portions are caused at 900° C.

Figure 9:
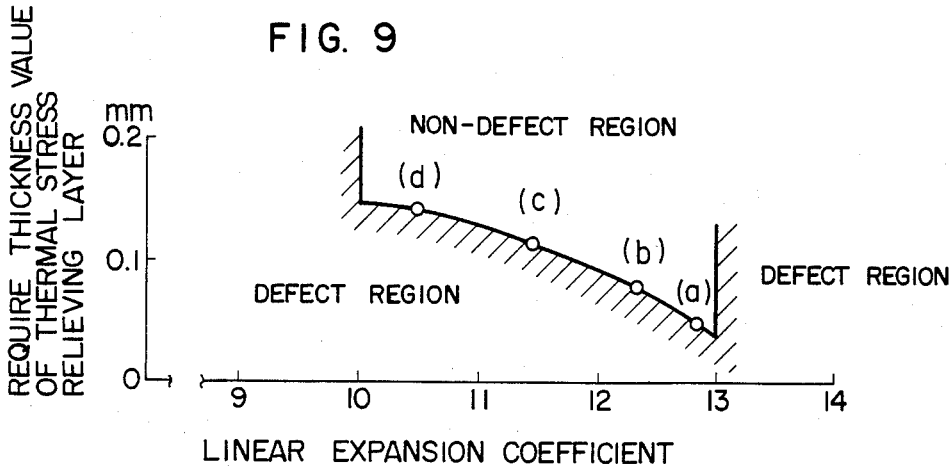
FIG. 9 is a graph showing the mutal relationship among: the defect region where defect portions, such as transverse cracking and oxidized portions, which are not practically allowable are caused, and the non-defect region where such defect portions are not caused; the thermal stress relieving layer thickness; and the linear expansion coefficient of the thermal stress relieving layer.

FIG. 9 shows the relationship between the defect region where the transverse crackings and oxidized portions which are not practically allowable are caused, and the non-defect region where no defect portions are produced, according to the relationship between the linear expansion coefficient of the material for the thermal stress relieving layer and the thickness thereof shown in FIG. 8.

Shown in FIG. 9 are data in FIG. 8 under the conditions where the plug central electrode temperature is 900° C., and symbols (a) to (d) in FIG. 9 correspond to the thermal stress relieving layer materials (a) to (d) in FIG. 8, respectively. In FIG. 9, the linear expansion coefficient of the discharging layer *7a* is in the vicinity of $9\times10^{-6}$/°C., while the linear expansion coefficient of the base metal 6 is in the vicinity of $13.5\times10^{-6}$/°C. Therefore, it is obvious that the defect region will be caused if the thermal stress relieving layer is constituted by a material having a linear expansion coefficient close to those of the discharging layer *7a* and the base metal *6a*. On the other hand, if the linear expansion coefficient of the thermal stress relieving layer is $10\times10^{-6}$/°C., the thickness thereof is required to be at least 0.15 mm. Hence, it is clear that the non-defect region is obtained by selecting the linear expansion coefficient and the thickness of the thermal stress relieving layer so that they satisfy such proper combination conditions. Moreover, it is apparent that if the linear expansion coefficient of the thermal stress relieving layer is selected to be $13\times10^{-6}$/°C., the thickness thereof is required to be at least 0.05 mm in order to obtain the non-affected region.

Accordingly, within the linear expansion coefficient range of the thermal stress relieving layer, between $10\times10^{-6}$/°C. and $13\times10^{-6}$/°C., the thickness of the thermal stress relieving layer should be made larger as the linear expansion coefficient decreases, while the thickness thereof should be made smaller as the linear expansion coefficient increases. In this case, the thickness of the thermal stress relieving layer is, as a matter of cource, between at least 0.05 mm and about 0.15 mm.

Figure 10A:
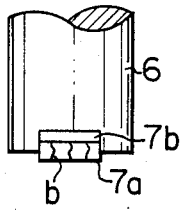
FIG. 10-A shows how longitudinal crackings (b) are caused in the spark plug discharging layer.
Figure 10B:
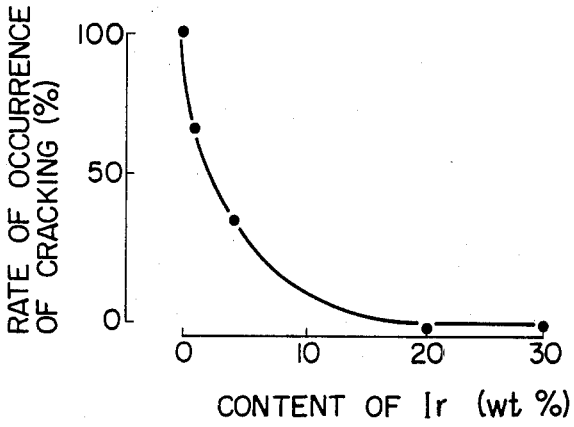

On the other hand, the discharging layer *7a* may be constituted by Pt solely in view of only the wear due to the spark discharge. If the discharging layer *7a* is constituted by Pt solely, however, longitudinal crackings (b) as shown in FIG. 10-A are produced in the discharging layer *7a*. In order to suppress the production of the crackings, it is preferable to add Ir to Pt. The relationship between the cracking production rate and the amount of addition of Ir is shown in FIG. 10-B. As will be obvious from the Figure, the amount of addition of Ir is preferably selected to fall between 10 wt % and 30 wt %. A more preferably range is between 15 wt % and 30 wt %. An Ir amount in excess of 30 wt % increases the hardness of the material itself constituting the discharging layer *7a* to make it difficult to work the material into a desired shape. It is to be noted that each of the above-mentioned amounts of Ir is a value that, together with a Pt content, totals to 100 wt %.

These discharging layer *7a* and the thermal stress relieving layer *7b* have linear expansion coefficients approximate to each other, so that there will hardly be a thermal stress due to a difference in linear expansion coefficient between the layers *7a* and *7b*.

The Ni content of the platinum chip layer 9 provided on the ground electrode 8 is preferably selected to fall between 5 wt % and 60 wt %, more preferably between 5 wt % and 20 wt % for aiming at approximating the linear expansion coefficient of the platinum chip layer 9 to that of the Ni alloy as the base metal consituting the electrode 8 as well as improving the wear resistance. In the platinum chip layer 9, as the Ni content increases, the wear due to oxidation progresses all the worse. In this connection, the Ni content of the platinum chip layer 9 is preferably minimized, since the ground electrode 8 has a temperature about 100° C. higher than that of the central electrode 6 and therefore the progress of oxidation of Ni in the platinum chip layer 9 is faster than that of Ni in the central electrode 6.

The invention is not limitative to the above-described embodiment and various changes and mocifications may be imparted thereto as follows.

(1) In case of employing an ignition circuit in which the ground electrode 9 is positive in polarity, the ground electrode 9 may adopt the combination of the discharging layer *7a* and the thermal stress relieving layer *7b* provided on the central electrode 6 in the above-described embodiment.

(2) Both the central electrode 6 and the ground electrode 9 may be provided with double platinum layers each constituted by the discharging layer *7a* and the thermal stress relieving layer *7b*, respectively.

(3) An alloy layer may be formed at the joint between the thermal stress relieving layer *7b* and the base metal constituting the central electrode 6 by subjecting the central electrode 6, when it is a single element, to a heat treatment at 1000° C. for three hours. This permits the thermal stress to be further relieved. It is to be noted that the alloy layer desirably has a thickness of at least 10$\mu$.

(4) The end of the central electrode 6 may be reduced in diameter to between 0.7 mm and 1.2 mm, and may be tapered. Such a shape makes it possible to improve the ignitability.

(5) The double platinum layer 7 on the central electrode 6 preferably has a diameter of 0.9 mm and a thickness of 0.4 mm (a weight of about 5.5 mg $\pm$2 mg), while the platinum chip layer 9 on the ground electrod 8 preferably has a diameter of 0.7 mm and a thickness of 0.3 mm (a weight of about 2.5 mg $\pm$1 mg). The dimensions and weights on the order of the above can satisfy conditions on both cost and life.

(6) The base metal constituting the central electrode 6 may consist essentially of 93 wt % Ni, 2 wt % Cr, 3 wt % Mn and 2 wt % Si.

(7) Each of the layers *7a*, *7b* and 9 may include unavoidable impurities.

(8) The thermal stress relieving layer may be constituted by a combination of materials having linear expansion coefficients between $10\times10^{-6}$/°C. and $13.0\times10^{-6}$/°C., in addition to a Pt-Ni alloy, e.g., Au-Pd, Pt-Pd, Pt-Rh, Pt-Au and Pt-Ag alloys.

As has been described, according to the invention, a thermal stress relieving layer is interposed between a platinum discharging layer provided on an electrode and the base metal constituting the electrode, the thermal stress relieving layer being made of a platinum base alloy containing nickel, which is included in the base metal. Therefore, the thermal stress caused between the discharging layer and the base metal constituting the electrode can be relieved by the thermal stress relieving layer. Accordingly, the falling off of the discharging layer can be prevented advantageously.

What is claimed is:

1. A spark plug for internal-combustion engines having a spark discharge gap defined between at least two electrodes opposing to each other, and a platinum-containing wear-resistant discharging layer provided on one of said electrodes, said spark plug comprising:

a thermal stress relieving layer disposed between said discharging layer and the base metal constituting said one electrode, said thermal stress relieving layer being made of a platinum base alloy containing nickel which is a main constituent of said base metal.

2. A spark plug for internal-combustion engines according to claim 1, wherein said discharging layer is made of a material consisting essentially of 70 to 90 wt % platinum and 30 to 10 wt % iridium.

3. A spark plug for internal-combustion engines according to claim 2, wherein said thermal stress relieving layer is made of a material consisting essentially of 5 to 95 wt % platinum and 95 to 5 wt % nickel.

4. A spark plug for internal-combustion engines according to claim 3, wherein another platinum-containing wear-resistant layer is provided on the other of said electrodes, said wear-resistant layer being made of a material consisting essentially of 5 to 60 wt % nickel and 95 to 40 wt % platinum.

5. A spark plug for internal-combustion engines according to claim 1, wherein the linear expansion coefficient of said thermal stress relieving layer is selected to fall between $10\times10^{-6}$/°C. and $13\times10^{-6}$/°C., and when the linear expansion coefficient is $10\times10^{-6}$/°C. the thickness of said thermal stress relieving layer is selected to be at least 0.15 mm; when the linear expansion coefficient is $13\times10^{-6}$/°C. the thickness of said thermal stress relieving layer is selected to be at least 0.05 mm, and moreover, within said linear expansion coefficient range, as said linear expansion coefficient decreases, the thickness of said thermal stress relieving layer is made larger; as said linear expansion coefficient increases, the thickness of said thermal stress relieving layer is made smaller.

6. A spark plug for internal-combustion engines according to claim 5, wherein said discharging layer is made of a material consisting essentially of 70 to 90 wt % platinum and 30 to 10 wt % iridium.

7. A spark plug for internal-combustion engines according to claim 2, wherein said thermal stress relieving layer is made of a material having a composition which consisting of 70 to 90 wt % platinum and 30 to 10 wt % nickel.

8. A spark plug for internal-combustion engines according to claim 7, wherein another platinum-containing wear-resistant layer is provided on the other of said electrodes, said wear-resistant layer being made of a material consisting essentially of 5 to 60 wt % nickel and 95 to 40 wt % platinum.

* * * * *